US005233866A

United States Patent [19]

Desbrandes

[11] Patent Number: 5,233,866

[45] Date of Patent: Aug. 10, 1993

[54] APPARATUS AND METHOD FOR ACCURATELY MEASURING FORMATION PRESSURES

[75] Inventor: Robert Desbrandes, Baton Rouge, La.

[73] Assignee: Gulf Research Institute, Chicago, Ill.

[21] Appl. No.: 689,460

[22] Filed: Apr. 22, 1991

[51] Int. Cl.[5] ..... E21B 49/00

[52] U.S. Cl. ..... 73/155

[58] Field of Search ..... 73/151, 155; 166/100, 166/264

[56] References Cited

U.S. PATENT DOCUMENTS

| | | | |
|---|---|---|---|
| 3,011,554 | 12/1961 | Desbrandes et al. | 166/100 |
| 3,858,445 | 1/1975 | Urbanosky | 73/155 |
| 3,859,850 | 1/1975 | Whitten et al. | 73/155 |
| 3,859,851 | 1/1975 | Urbanosky | 73/155 |
| 4,434,653 | 3/1984 | Montgomery | 73/155 |
| 4,513,612 | 4/1985 | Shalek | 73/155 |
| 4,742,459 | 5/1988 | Lasseter | 364/422 |

*Primary Examiner*—Hezron E. Williams
*Assistant Examiner*—Michael Brock
*Attorney, Agent, or Firm*—Llewellyn A. Proctor

[57] ABSTRACT

Test apparatus, and method for accurately and quickly measuring formation pressure, and permeability in oil and gas producing formations; especially low or high permeability formations. The test apparatus can be transported on a drill string, or cable. Preferably, it is employed as a component of a wireline test apparatus. The test apparatus includes, as part and parcel of the combination, an extended drawdown subassembly, or formation pressure test unit, directly associated with the tool flowline. By applying a very slow rate of pressure decrease in the tool flowline, the formation pressure and permeability can be quickly determined, generally during the first minute of testing. In high permeability and soft formations, the formation pressure is determined even if the seal is lost during the flowing period. In low permeability formations, corrections can be made for the supercharging effect using the data collected. A simple mathematical model can be used for determining formation pressure, formation permeability, supercharging, and mudcake characteristics from the data obtained.

12 Claims, 5 Drawing Sheets

APPARATUS AND METHOD FOR ACCURATELY MEASURING FORMATION PRESSURES

FIELD OF THE INVENTION

This invention relates to apparatus and method for accurately, and quickly measuring the formation pressure, and permeability in an oil or gas producing formation. The apparatus can be borne by cable, or a drill string. The tool, inter alia, thus relates, in particular to an improved wireline testing tool, and method for testing the formation pressure, formation permeability, and other values of oil or gas producing formations.

BACKGROUND

Wireline formation testers, tools for the extraction of formation fluids from the wall of an open borehole full of mud, have been known for many years; and tools of this class are used extensively in oil and gas exploration. Typically, a tool of this type includes a fluid entry port, or tubular probe cooperatively arranged with a wall-engaging pad, or packer, which is used for isolating the fluid entry port, or tubular probe from the drilling fluid, mud, or wellbore fluids during the test. The tool, in operating position, is stabilized via the packer mechanism within the wellbore with the fluid entry port, or tubular probe, pressed against the wall of the subsurface formation to be tested. Gas, or other fluid, or both, is passed from the tested formation into the fluid entry port, or tubular probe via a flowline to a sample chamber of defined volume and collected while the pressure is measured by a suitable pressure transducer. Measurements are made and the signals electrically transmitted to the surface via leads carried by the cable supporting the tool. Generally, the fluid pressure in the formation at the wall of the wellbore is monitored until equilibrium pressure is reached, and the data is recorded at the surface on analog or digital scales, or both.

The tools in present use have generally performed satisfactorily in measuring formation pressures, and permeability determinations, when testing medium permeability, consolidated formations. This is not the case however, when testing tight (low permeability) or unconsolidated (very high permeability) formations. Clay particles, naturally occurring or introduced by the drilling fluid, exist in the wall pore space. In low permeability formations, these particles often adversely affect tests run at conventional flow rates by blocking the pore throats. In a tight zone, high permeability streaks release fluids and produce a buildup. The chances of setting the tool in a tight spot are always large, resulting in a "dry" test. The flowing pressure drops rapidly to zero and stays there. Most of the time no buildup occurs. When a slow buildup is recorded, starting next to zero pressure, it may be the result of fluid flow from the formation, but most likely it is due to a small leakage between the pad and the sandface. The pressure creeps slowly up, with a buildup-like shape, since the leakage decreases with the differential pressure between the borehole and the flowline. If the tester is left in place long enough, the pressure may go up to mud pressure. Needless to say, the buildup curve is meaningless in such a case.

Tight formation testing is also complicated by the supercharging effect. The mud filtrate, which is forced through the mudcake, is injected into the formation. This injection of mud filtrate causes a pressure buildup in the formation. The sandface pressure, pressure measured immediately behind the mudcake, may exceed the formation pressure by up to several hundred psi depending on the mudcake and formation permeabilities.

In medium permeability, shaly formations, damage due to both mud filtrate invasion and drilling fluid small particles invasion may render the invaded zone quasi-impervious. The filtrate damaged zone may extend several feet deep, and the particles damaged zone, up to ⅛th of an inch deep. Such a formation behaves like a tight zone; dry tests, slow buildups, and pad leakage may be experienced.

In very soft formations such as those encountered in the Gulf Coast, even when using sophisticated snorkel tubes and filters, the formation craters during the flow period and the seal is lost. The pressure in the flowline jumps to hydrostatic mud pressure and no buildup is recorded.

OBJECTS

It is, accordingly, the primary objective of this invention to provide an improved apparatus, and method, for testing the formation pressure in oil or gas producing formations; particularly in low permeability and high permeability formations.

In particular, it is an object to provide an improved testing apparatus for lowering into wellbores, via attachment to the end of a cable or drill string, for determining formation pressure, formation permeability, supercharging and mudcake characteristics.

The Invention

These objects and others are achieved in accordance with this invention, an apparatus embodiment of which includes, preferably as a component of a wireline test tool, or generally similar apparatus borne by a drill string, an extended drawdown subassembly, or formation pressure test unit, which comprises a pair of interconnected liquid filled chambers, each connected through a controlled valve opening with the passageway and pressure gauge, a first chamber containing a reciprocably mounted piston to provide a variable volume chamber for controlling, when the valve is opened, the pressure applied upon the pressure gauge for stabilization of pressure during testings, and a second chamber for measuring, when the valve is opened, the pressure drawdown rate of the penetrated formation as flowline pressure drops below formation pressure, providing a means for determining very quickly formation pressure and formation permeability.

The apparatus includes, in particular, as part of the apparatus combination, the usual tool body, and passageway into the drill body housing test components which includes a pressure gauge, and at least one test chamber for adjusting, or regulating the flow rate of connate fluids introduced into the passageway from the subsurface formation. The tool also contains the usual means for affixing and stabilizing the tool body in the wellbore at the level of the formation to be tested, this including an extensible packer assembly, and pad with pad opening adapted for sealing engagement and alignment of the pad opening with the passageway into the tool to isolate same from wellbore fluids, and to establish a path for fluid communication between the subsurface formation and the tool body passageway. The improvement in the overall apparatus combination further requires the presence of the extended drawdown subassembly, or pressure formation test unit, constituted of a pair of interconnected liquid filled chambers, each connected through a controlled valve opening with the passageway and pressure gauge, a first chamber the volume of which can be varied by the presence of a reciprocably mounted piston for adjusting, regulating, and controlling, when the valve is opened, the pressure applied upon the pressure gauge during testing, and a second chamber for measuring, when the valve is opened, the pressure drawdown rate of the penetrated formation as the flowline pressure drops below formation pressure, providing a means for determining very quickly formation pressure and formation permeability.

The use of the extended drawdown subassembly, or formation pressure test unit, as part and parcel of the overall combination makes it feasible to accurately, and quickly test formations, particularly low permeability and high permeability formations, to determine formation pressure, formation permeability, supercharging and mudcake characteristics. By using a very slow rate of pressure decrease in the tool flowline, the formation pressure and permeability can be determined quite quickly, generally within the first minute of testing. No pressure buildup is necessary, as required in accordance with conventional techniques. In low permeability formations, corrections can be made for the supercharging effect using the data collected. In high permeability and soft formations, the formation pressure can be determined even if the seal is lost during the flow period. A simple mathematical model can be used for determining formation pressure, formation permeability, supercharging and mudcake characteristics.

A preferred apparatus, method, and the principles of operation of said apparatus, and method, will be more fully understood by reference to the following detailed description, and to the drawings to which reference is made in the description. The various features and components in the drawings are referred to by numbers, similar components being represented in the different views by similar numbers. Subscripts are used in some instances with members where there are duplicate parts or components, or to designate a sub-feature or component of a larger assembly.

REFERENCE TO THE DRAWINGS

FIG. 3, or more specifically FIGS. 3A, 3B, 3C and 3D are a series of fragmentary views representative of the positioning, and functioning of the extended drawdown sub-assembly, or test unit, as employed in the measurement of formation pressure, and permeability.

Figure 4:
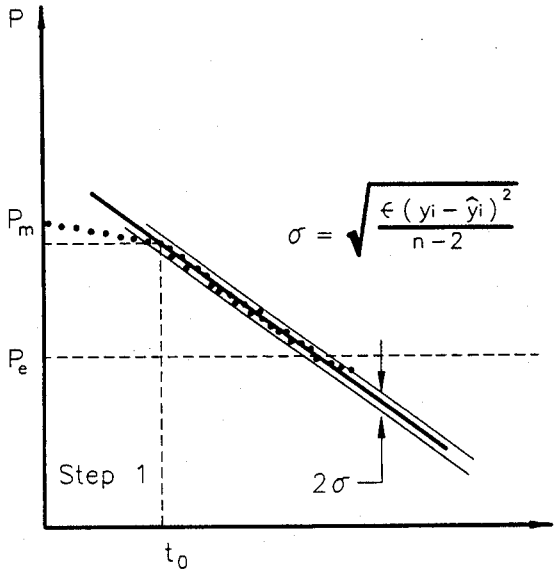

FIG. 4 graphically depicts the early drawdown period initiating a cycle of operation of the extended drawdown sub-assembly, or test unit, which becomes essentially a straight line function, decreasing gradually from a higher value for mud pressure, $P_m$, and ending with a lower value for formation pressure, $P_e$.

Figure 5:
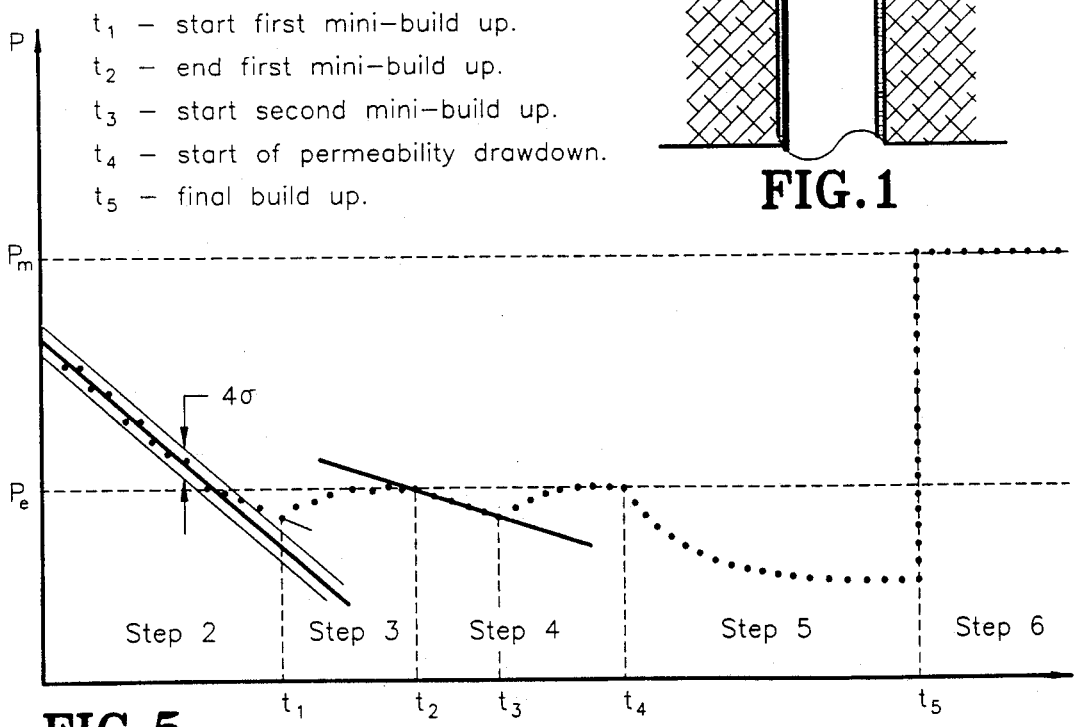

FIG. 5 graphically depicts the balance of the curve, typical of a cycle of operation of the extended drawdown sub-assembly, or test unit, employed in the measurement of formation pressure, and permeability.

Figure 6:
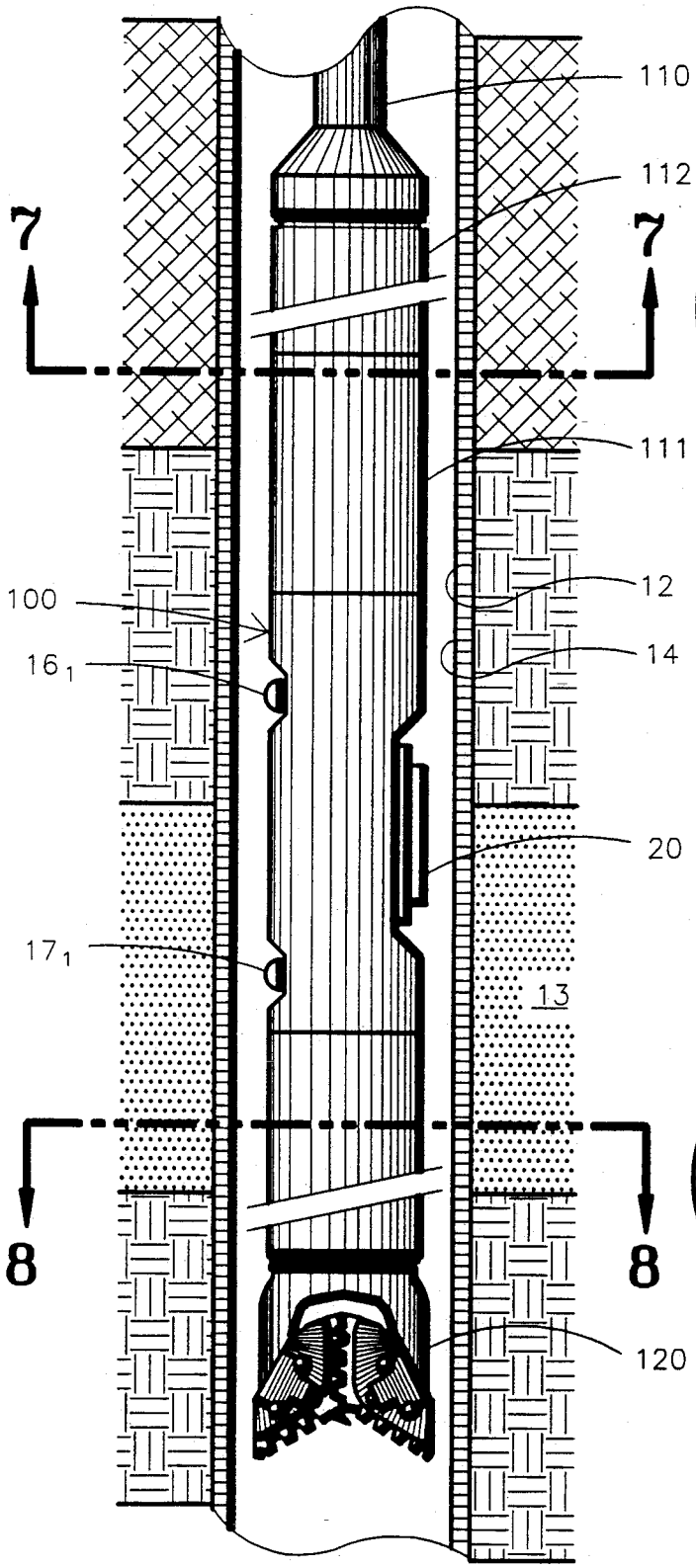

FIG. 6 depicts a tool as previously described, except that in this instance, the tool per se is incorporated in a drill string just above the bit and borne by the drill string. The drill string is thus used to lower and raise the tool in the wellbore, and carries the required electronic circuitry for transmitting signals, and commands from the surface to the tool, and vice versa.

Figure 7:
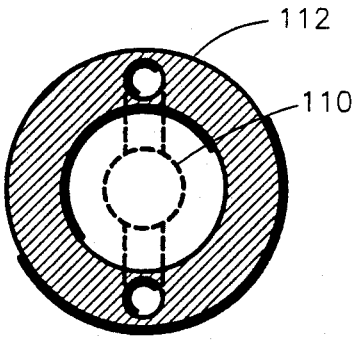

FIG. 7 is a cross-section taken through Section 7—7 of FIG. 6.

Figure 8:
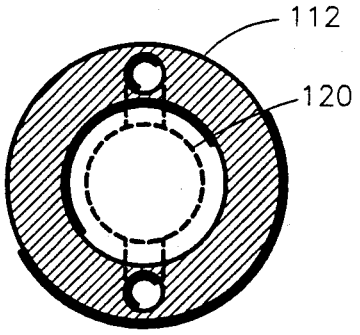

FIG. 8 is a cross-section taken through Section 8—8 of FIG. 6.

Figure 9:
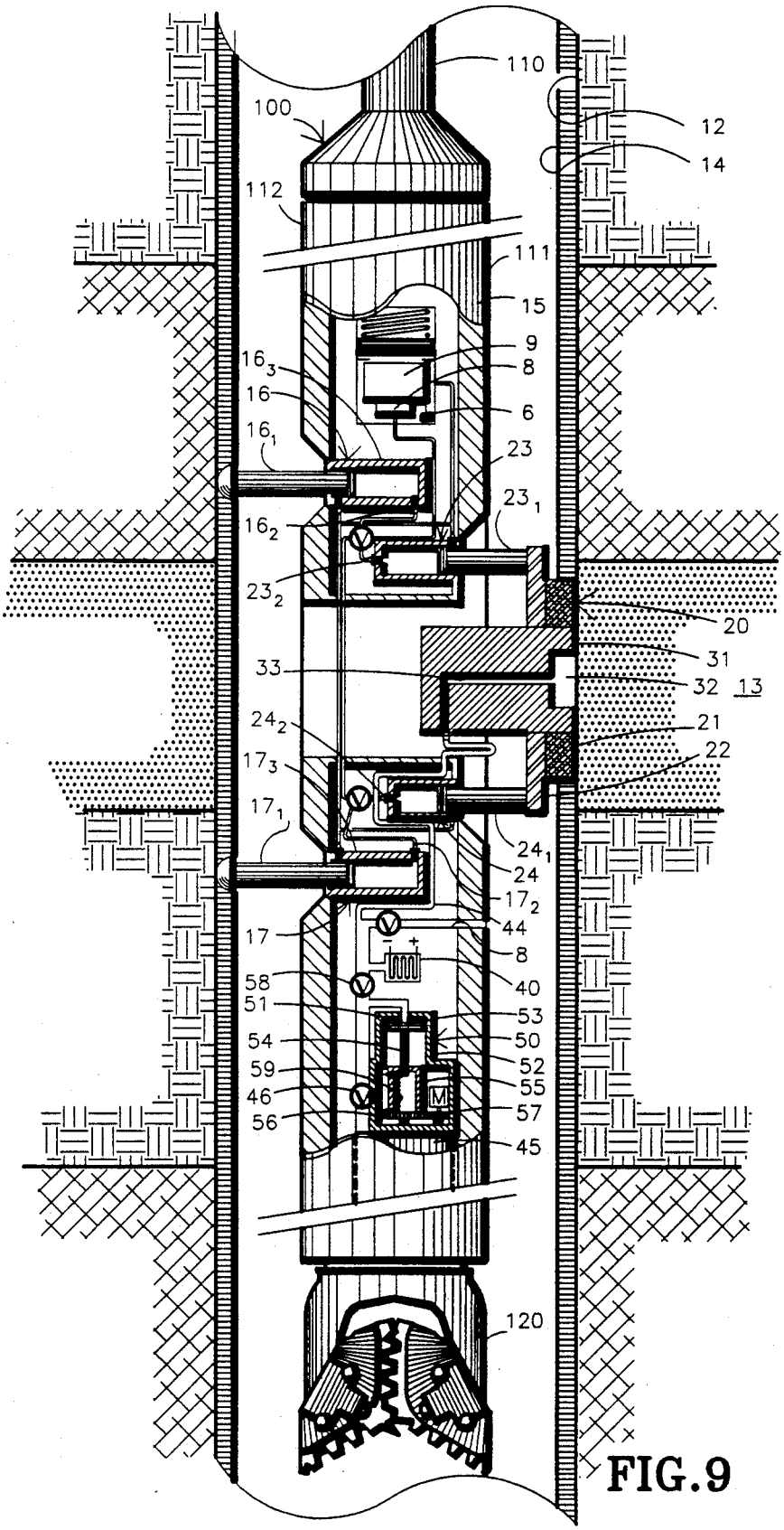

FIG. 9 is a partial cross-sectional view of the tool described by reference to FIGS. 1 through 5 except that in this instance the tool is drill string borne, and includes ducts for transport of drilling fluid from the drill string to the bit. Activation of the tool as required in its operation, and function, can be made by the transmission of mud pressure signals sent from the surface, while data is transmitted to the surface by mud pressure signals. These and other electronic communication techniques per se are well within the skill of the present art.

Figure 1:
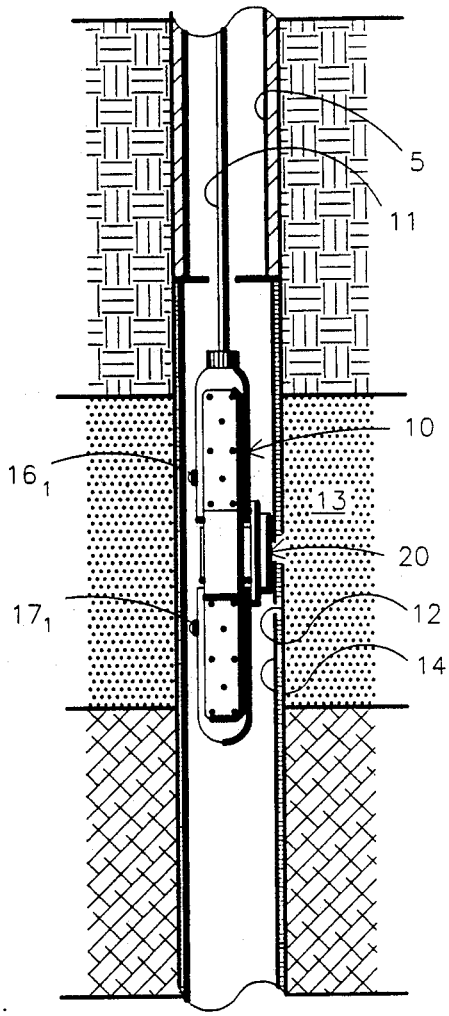
FIG. 1 depicts a novel, improved type of wireline testing tool useful for testing the formation pressure, and formation permeability, in a subsurface formation. The tool in this instance is suspended via a cable within a wellbore, after having been lowered from the surface through a number of formations.

Referring first to FIG. 1, there is shown a wireline testing tool 10, as the tool would appear after it had been lowered from the surface through a series of subsurface formations and wellbore casing 5 on a multiconductor cable 11 into a fluid or mud filed wellbore 12, or borehole, to a level opposite a specific subsurface formation 13 to be tested. The tool 10 is suspended in the mud filled borehole 12 from the lower end of the multiconductor cable 11 that is conventionally spooled at the surface on a suitable winch and coupled to a tool control system, recording and indicating apparatus, and power supply, not shown. Control signals are electrically transmitted from the surface, and measurements made with the tool 10 are transduced into electrical signals and transmitted as data via the multiconductor cable 11 to the surface recording and indicating apparatus; this generally including both analog and high resolution digital scales. Control from the surface permits operators to place the tool 10 at any of a number of operating positions, and to selectively cycle the tool from one position to another as may be required. These control mechanisms per se for control and manipulation of the tool from the surface are conventional, as are the data gathering and recording techniques.

Figure 2:
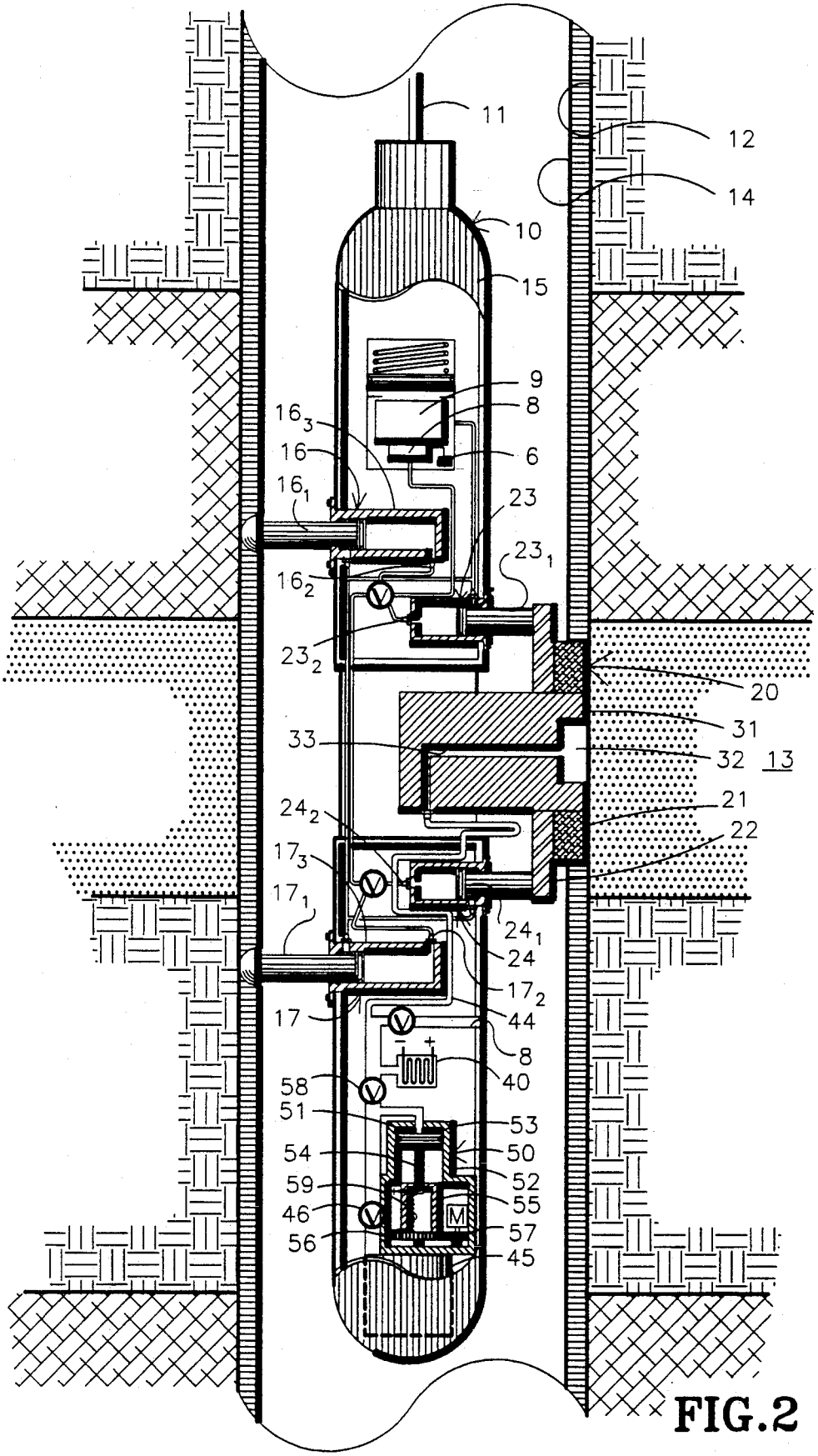
FIG. 2 depicts, in a somewhat enlarged sectional view, the wireline testing tool with an external wall removed to expose various sub-assemblies, particularly the extended drawdown sub-assembly, or test unit, for measuring formation pressure, and permeability. In this figure the tool is set in place within the wellbore at the wall of the formation to be tested.

Continuing the reference to FIG. 1, and also to FIG. 2, the tool 10 is constituted of an elongated body formed by an enclosing wall 15. At locations just above and just below the mid section, respectively, and on one side of the elongated body there is located a pair of selectively extendible anchoring pistons $\mathbf{16}_1$, $\mathbf{17}_1$ and on the opposite side thereof a packer assembly 20, which includes a pad 21 which is also extendible outwardly from the surface of the body 15 via a pair of laterally movable pistons $\mathbf{23}_1$, $\mathbf{24}_1$. The simultaneous extension of the pistons $\mathbf{16}_1$, $\mathbf{17}_1$ and pad 21 from within the body of the tool 10, via actuation of pistons $\mathbf{23}_1$, $\mathbf{24}_1$, for contact with the surrounding wall 12 of the subsurface formation 13, as shown by reference to FIG. 2, lock and stabilize the tool 10 in place for operative analysis. So positioned, the pad 21 provides a means for sealing off a selected portion of the wall of borehole 12 from the wellbore fluid, or mud, and for establishing a passageway between the tool 10 and subsurface formation 13 so that fluid may be transferred from inside the formation 13 into the tool for analysis.

A hydraulic system, which includes a motor 9, pump 8 and reservoir 6, per se of conventional design is operatively connected to a manifold, through multiport valved connections, provide the hydraulic power required for actuation of the pistons $16_1$, $17_1$, and pistons $23_1$, $24_1$ of the packer assembly 20. The pistons $16_1$, $17_1$ are components of hydraulically actuated cylinder-piston units 16, 17. Hydraulic fluid, under pressure, introduced via lines $16_2$, $17_2$ into the rearward ends of the housings of the cylinder-piston units 16, 17 produce extension of the pistons $16_1$, $17_1$ from within their enclosing housings, or cylinder $16_3$, $17_3$. The helical springs seated in the forward ends of the cylinder-piston units 16, 17 are compressed on extension of the pistons $16_1$, $17_1$ so that on reversal of the applied pressure, and release of the applied pressure, the pistons $16_1$, $17_1$ are withdrawn or retracted into their respective cylinders or housings. Suitably, double acting cylinder-piston units can be employed, i.e., hydraulic fluid could be alternately applied to the two ends of a cylinder $16_3$, $17_3$, respectively, to extend and retract a piston $16_1$, $17_1$, respectively.

The packer assembly 20 is constituted of a sealing pad 21, a support plate 22 on which the pad 21 is mounted, and a pair of hydraulically actuated pistons $23_1$, $24_1$ via means of which the pad 21 can be extended, simultaneously with pistons $16_1$, $17_1$, into contact with the wall surface of the borehole 12, to affix and stabilize the tool 10 within the borehole. Conversely, when required, these pistons 23, 24 can be retracted simultaneously with pistons $16_1$, $17_1$ to release the tool 10 from its previously selected position within the borehole 12. Extension of the pistons $23_1$, $24_1$ is accomplished by the introduction of hydraulic fluid into the rearward ends of the housings 23, 24 of these units via lines $23_2$, $24_2$. Retraction of the pistons $23_1$, $24_1$ occurs via the introduction of pressurized hydraulic fluid into the opposite side of the housing of the cylinder-piston units 23, 24. Alternatively, compressed coil springs can be employed to retract the pistons. Besides this function, in any event, the packer assembly 20, after the tool 10 has been lowered from the surface to a level opposite a wall of the targeted subsurface formation 13, is used to seal off from borehole fluid, or mud. a selected portion of the borehole wall 12, with its mudcake lining 14, and provide a path, or passageway, for the transfer of connate fluid from within the subsurface formation into the tool for testing.

The extended drawdown sub-assembly, or formation pressure test unit 50, is constituted of a pressure gauge 40, inclusive of a pressure sensor (not shown), directly communicated with the passageway 44, and a pair of interconnected chambers, 45, 51 each also connected through a controlled valve, 46 and 58, respectively, with the passageway 44, and pressure gauge 40. The first of these chambers, chamber 51, is one the volume of which can be varied due to the presence of a movable piston. Retraction, or withdrawal, of the piston from within the housing wall forming the chamber opens the chamber; continuing withdrawal of the piston increasing the volume of the chamber Upward movement of the piston decreases the volume, and closes the chamber. The variable volume chamber is directly communicated with the passageway 44. The variable volume chamber 51 is thus provided via use of a cyclinder-piston unit; a unit constituted of a housing 52, or wall surrounding a cylindrical shaped opening within which is fitted a reciprocably mounted piston 53. The piston 53, suitably, is mounted on the upper end of a threaded shaft 54, which in turn is mounted, via threadable means, within a rotatable body 55, coupled with a motor gear drive. With valve 58 open, on withdrawal of the piston 53 the chamber 51 can be opened and its volume progressively increased. Conversely, on advancing the piston 53 upwardly into the chamber 51, the chamber volume can thus be progressively decreased, and closed. Thus, activation of the motor M, moves the gears 57, 56 in one direction to raise the shaft 54 which carries the piston 53 into the cylindrical opening of the housing 52, this progressively decreasing, and closing the chamber; or alternatively activation of the motor M to move the gears 57, 56 in the opposite direction withdraws the piston 53 from the housing 52 to open the chamber. A potentiometer circuit 59 is provided to monitor, and record the position of the piston 53 within the housing 52; and via electrical circuitry, not shown, the signal can be carried to the surface, and read at the surface. The motor M, and the pressure gauge 40 are also provided with electrical circuitry, and leads for control from the surface. The second chamber 45, connected via the valve 46 to the passageway 44 is of fixed volume. Its function is to facilitate the retention of the slow pressure decrease rate. It is also an essential component of the extended drawdown sub-assembly, or formation pressure test unit 50. Its function, as well as the function of the extended drawdown sub-assembly 50 as a whole will be better understood by the following description of a complete cycle of operation, specific reference being made to FIG. 3, or more specifically FIGS. 3A, 3B, 3C and 3D, and by reference to FIGS. 4 and 5 which explain the methodology of the operation.

In operation of the tool, with the tool now positioned in the wellbore opposite the formation to be tested, the pistons $23_1$, $24_1$ are projected outwardly, which moves the pad 21 of the packer assembly 20 into contact with the surface of the wellbore. The pad 21 is thus pressed tightly against the wall of the wellbore opposite the formation to be tested, by virtue of which the interior of the tool 10 is isolated from the wellbore fluid.

A complete cycle of operation, beginning just after lowering the tool to a preselected depth into the borehole, is described as follows: A first step, Step 1, is required where it is necessary to compute supercharging; as occurs in low permeability, or tight formations. Thus, in order to keep the formation from producing into the borehole the mud hydrostatic pressure must be greater than the sandface pressure, i.e., $P_m > P_{SF}$. Consequently, in a tight formation some filtration through the mudcake will take place and the pressure in the flowline will decrease slowly. This decrease can be related to filtration rate, a value which can be used later to correct for supercharging.

Figure 3A:
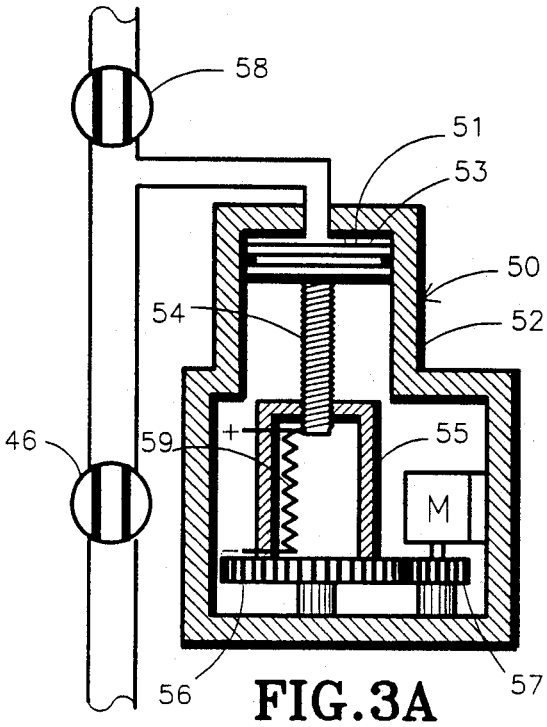

Step 1: Reference is first made to FIG. 3A, and also to FIG. 4. To begin an operation, valves 46, 58 are opened and piston 53 is thrust to its extreme upward position. The tool is set in place by pressing the pistons $16_1$, $17_1$ and pad 20 against the wall of the formation. The formation 13 is open to the entry 32 of the block 31, constituting a component of the packer assembly 20, via passageways 33, 44 past valved equilibrium line 8 to the extended drawdown sub-assembly 50 (FIG. 2). So positioned, the chamber 45 is filled with drilling mud (or previously filled with a liquid, e.g., water). The pressure gauge 40 reads the hydrostatic mud pressure.

The pressure on the flowline side is hydrostatic pressure. On the formation side of the mudcake the pressure is the sandface pressure. In a high permeability formation, the sandface pressure is the same as the formation, or reservoir, pressure. In a low permeability formation due to supercharging the sandface pressure is somewhat larger than the formation, or reservoir, pressure. The tool, in either event, is maintained in place for a few minutes, generally about 1 or 2 minutes. During this time a slow leakage of the mudfiltrate through the mudcake will produce a small pressure decrease in the flowline which can be measured. This decrease is read by the sensor of the pressure gauge 40. This decrease in pressure, which can be used to correct for supercharging, is represented by reference to FIG. 4 of the drawing. The pressure begins to decrease beginning at the high value $P_m$, mud pressure, and moves very gradually downwardly to $t_o$.

To compute supercharging, a comparison, or calculation, can be done to determine the flowrate of mudfiltrate through the mudcake during this step, and correction made for the supercharging effect.

Figure 3B:
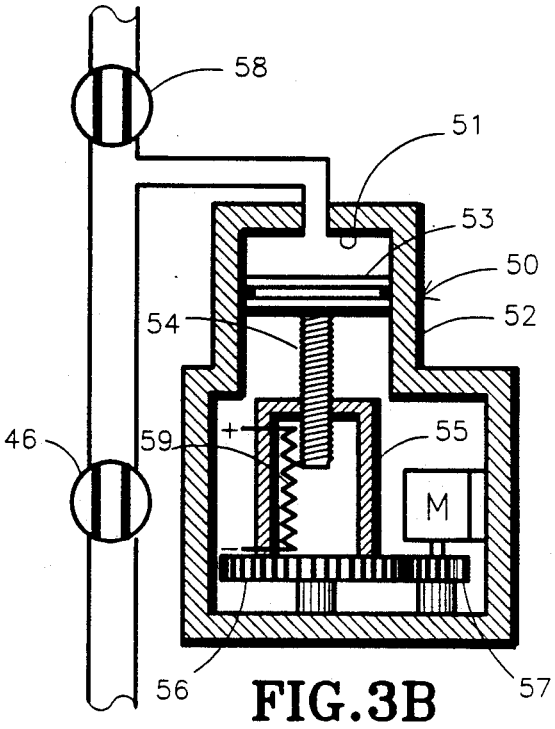
Figure 3C:
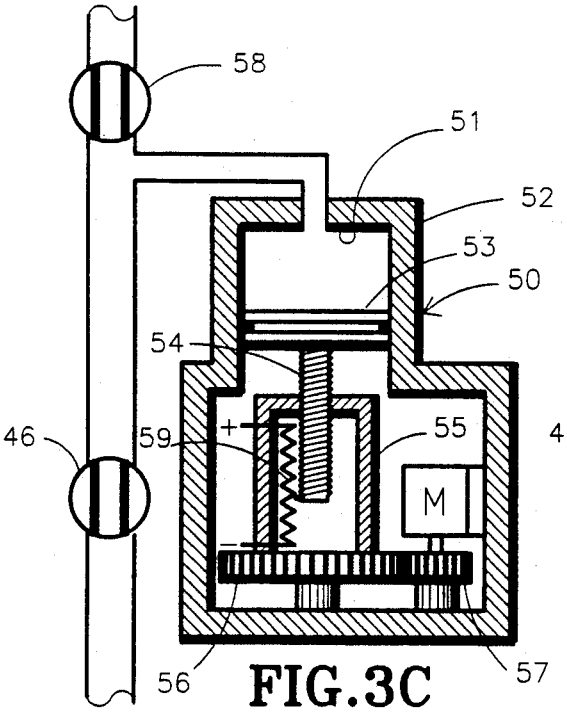

Step 2: Reference is now made to FIG. 3B; and the reference to FIG. 4 is continued. The electric motor M is actuated at time $t_o$ and the piston 53 is slowly withdrawn to gradually increase the volume of the chamber 51. Due to the volume increase the pressure within the flowline slowly decreases. The pressure decreases as well on the pad-side of the mudcake. An essentially straight line is drawn as time moves from $t_o$ toward $t_l$.

Since the rate of leakage is small compared to the volume increase rate of chamber 51, or chamber evacuated behind piston 53, the flowline pressure decreases more rapidly.

During this step, the pressure decrease in the flowline is monitored in order to calculate the best straight line fit and the standard deviation as the measurements become available. The last point or the last value of the pressure measured is permanently compared with the value calculated using the straight line. If the difference exceeds one or two standard deviations (two sigma), according to the degree of certainty desired, three orders are immediately given; (1) valve 46 is closed, isolating chamber 45; (2) motor M is stopped; and (3) valve 58 is closed, these steps reducing the volume of the flowline to a minimum.

There is also an alternative way to detect the departure from a straight line, to wit: (a) The derivative of the pressure readings can be compared using, e.g., 4 or 5 points in a progressive way, as time elapses and more points are available. (b) In the straight line portion of the curve the derivative is constant, but when the derivative decreases by 2 to 5% (according to the desired certainty), these steps are conducted as stated previously.

In conducting these steps, it is now known that a pressure below the formation pressure has been reached because the departure from the straight line is due to formation fluid inflow.

The departure may occur near sandface pressure or formation pressure, for the high permeability formations. On the other hand, the departure may occur substantially below the sandface pressure in low permeability formations.

Step 3: The pressure in the flowline will stabilize at the sandface pressure which, as indicated, is the formation pressure in high permeability formations. On the other hand, since a rather small area of the borehole wall has been drained slightly during this microtest, the sandface pressure is not substantially perturbed in a low permeability formation. At any rate, the pressure will build back rapidly to its original value due to formation fluid flow into the pad 20 via opening 32.

The departure from the straight pressure decrease line occurs soon after getting below the sandface pressure. The first mini buildup to sandface pressure, which ends the first drawdown period, begins at point $t_1$, reference being made to FIG. 5. The buildup takes but a short time; at any rate very much less than a standard buildup. Moreover, the accuracy of this measurement is better than in conventional tools since the differential pressure between the sandface pressure and the flowline pressure is less than in conventional tools. Furthermore, a mud leakage is not likely to occur. The buildup stops at point $t_2$ when the pressure reading is stabilized, reference again being made to FIG. 5.

Step 4: Sandface pressure can be verified if a check is deemed necessary due to poor stabiliation. Valves 46, 58 are opened as depicted by reference to FIG. 3C. When the pressure is stabilized, motor M is activated and a new drawndown is begun. The slope of the new pressure line i.e., the slope of the line between $t_2$ and $t_3$ as represented in FIG. 5, is compared to the slope of the line recorded in Step 2. If the slope is smaller, fluid is flowing from the formation. The motor is then stopped, valves 46, 48 closed, and the pressure allowed to build up to the sandface pressure in the flowline as represented by $t_2$ in FIG. 5. The pressure should then be the same as was reached in Step 3. If the pressure is not the same, then Step 4 should be repeated until the same stable value is reached.

In hard, low permeability formations the pad of the tool should preferably be hollow to avoid damage to the mudcake trapped inside. In soft formations, a snorkel type probe (not shown) may be provided but positioned in a retracted position to avoid damage to the mudcake during the operation. Thus, in soft formations, the snorkel is released to avoid cratering. The next step, Step 5, in any event, is to measure the permeability of the formation.

Figure 3D:
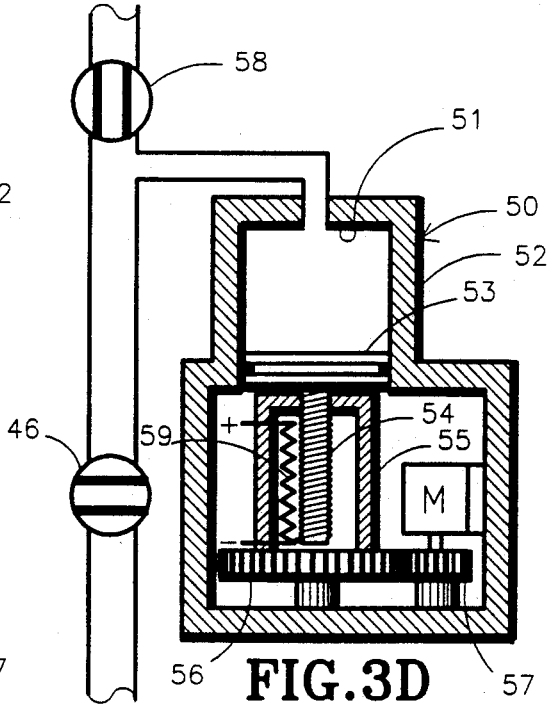

Step 5: Reference is now made to FIG. 3D, and to FIG. 5. To measure the permeability of the formation valve 58 is opened, valve 46 remains closed, and motor M is activiated. The pressure in the flowline decreases, beginning at time $t_4$ until it becomes stable. When the pressure becomes stable the formation is producing exactly at the flowrate of the volume increase due to the piston motion. A simple calculation can be used to determine the permeability.

If the pressure does not stabilize the curve can be compared to a calculated curve obtained by assuming a certain permeability. The permeability is then determined by curve matching.

Step 6: Valved line 5 is now opened and the flowline pressure increases up to the hydrostatic mud pressure as depicted at time $t_5$ in FIG. 5.

Since no differential pressure is acting on the pad, it can be unstuck from the borehole wall by closing the tool.

Motor M is actuated to bring the piston 53 to the up position. Valves 46, 58 are opened and the tool is ready for a new operation at the same or a different depth.

Via this cycle of operation, the following parameters can be readily determined, to wit:

mudfiltrate flowrate through the mudcake;

sandface pressure, i.e., the pressure behind the mudcake; and formation permeability.

By knowing the mudfiltrate flowrate and the formation permeability, the supercharging pressure can be calculated.

By subtracting the supercharging pressure from the sandface pressure, the formation pressure can be determined.

This method permits determination of two of the most important parameters in gas reservoir engineering; the pressure of the formation, and the permeability of the formation.

The mathematical computations necessary for making these calculations per se are well known, and within the skill of the art.

In conventional practice, rotary drilling features a rotary, or rotary table through which sections of pipe are run. A bit is attached, or "made up", on the drill pipe. Sections of drill pipe and special heavy wall tubes called drill collars make up a drill string. When the rotary is engaged, it rotates the drill string, and bit, and the wellbore is drilled by the rotating bit. A drilling fluid, or "mud", is pumped down the drill string, out the bit, and returned to the surface via the annular opening between the outside wall of the drill string and the wellbore. Cuttings made by the bit are thus removed from the wellbore and conveyed with the drilling fluid to the surface. The tool described by reference to the preceding figures, notably FIGS. 1 through 3, can also be carried on a conventional drill string, and employed in the manner heretofore described. Suitably, and preferably, the tool is carried at the end of a drill string just above the bit. The tool is integrated into a large segment of pipe, suitably a drill collar, provided with ducts to carry the drilling fluid, or mud, pumped downwardly from the surface through the drill string, around the tool to the bit.

Referring to FIG. 6 there is shown a mud filled wellbore 12 on the wall of which is deposited a mudcake 14, as previously depicted. The tool 100, which carries a pad 20 and pistons $\mathbf{16}_1$, $\mathbf{17}_1$, is identical in structure, and function, with tool 10 previously described except that the tool, instead of being carried on a wireline, is integrated into a heavy wall pipe, or drill collar, which is carried on the end of a drill pipe 110, and located just above a drill bit 120. Within the sections of drill collar, i.e., at sections 111 and 112, respectively, above the tool 100 there is contained power and data transmission equipment and data receiving equipment.

The tool per se is identical in structure, and function, as previously described by reference to FIGS. 1 through 6. The tool per se is thus represented by FIG. 9; differing from the tool represented by FIGS. 1 through 3 in that it is integrated within drill collars 111, 112 and borne at the end of a drill string 110. Repetition of the various assemblies, and sub-assemblies, and the function thereof, will only burden the application and consequently will be avoided.

In the operation of the tool described by reference to FIGS. 6 and 9, a drilling fluid, or mud passed downwardly from the surface via drill string 110 will pass through a pair of ducts, formed by openings separated 180° one from the other, to the bit 120 wherefrom the drilling fluid, or mud, will exit and then return to the surface via the annular opening between the outer wall of the casing and the wellbore 14. The tool is activated and guided in its operation by mud pressure signals sent from the surface, and data is also transmitted from the tool to the surface by mud pressure signals. Other electronic communication means can also be used, e.g., electromagnetic signals sent through the earth. Such means are well within the skill of the art, and per se form no part of the present invention.

It is apparent that various modifications and changes can be made without departing the spirit and scope of the present invention.

Having described the invention, what is claimed is:

1. In a process for rapidly, and accurately determining the formation pressure of a subsurface formation traversed by a fluid filled wellbore by establishing through a wall between said wellbore and said formation, a passageway, isolated from fluid within the wellbore, through which connate fluids from the subsurface formation can flow, the steps comprising:

measuring the pressure in the passageway, opening up the passageway to a chamber of variable volume and increasing the volume of the chamber at a rate sufficient to reduce the pressure in the passageway at an essentially constant rate, defining in effect a substantially straight line function of pressure vs. time, and continuing to decrease the pressure in said passageway until the measured pressure in the passageway ceases to define said straight line function, and begins to decrease at a decreasing rate, defining a minima, then keeping constant the volume of the chamber of variable volume so that the pressure increases and levels off at an essentially maximum value which accurately defines the formation pressure of said subsurface formation.

2. The process of claim 1 wherein the formation pressure is checked, beginning from the point defined as an essentially maximum value which characterizes the formation pressure, by again increasing the volume of the chamber of variable volume, measuring the pressure in the passageway as the pressure again begins to decrease at a decreasing rate, defining a second minima, then again keeping constant the volume of the chamber so that the pressure again increases and levels off at an essentially maximum value, then drawing a straight line through a number of plotted points of pressure readings lying between said initial point of maximum value where the check was begun and said second minima, and then comparing the slope of the straight line with the straight line of the straight line function previously obtained.

3. The process of claim 1 wherein, to determine via calculation the permeability of the formation, the volume of the variable volume chamber is again gradually increased, the pressure again decreasing until it reaches a minima at which point the formation is producing exactly at the flowrate of the volume increase of the variable volume chamber; a value from which the calculation can be made to determine the permeability of the formation.

4. In the process of claim 1 wherein the wall of the wellbore is coated with mudcake, mudcake is trapped in the passageway leading into the formation, and the pressure in the passageway is greater than the formation pressure, the step of determining the supercharging effect of the subsurface formation by monitoring the pressure in the passageway before initiating the increase in volume of the variable volume chamber, the pressure gradually decreasing with time due to the filtration of connate fluids through the mudcake, this rate of decrease in pressure providing a measurement of the supercharging effect.

5. The process of claim 1 including, as the chamber of variable volume is increased to reduce the flowline pressure to cause an essentially constant rate of pressure decrease in the passageway to define in effect the essentially straight line function, the steps of monitoring the pressure decrease in the passageway in order to calculate the best straight line fit and the standard deviation, comparing the last value of the pressure measured with the value calculated using the straight line, and reducing the volume in the passageway to a minimum if the difference between the last value of the pressure measured and a value calculated exceeds about two standard deviations.

6. The process of claim 1 including, as the chamber of variable volume is increased to reduce the pressure to cause an essentially constant rate of pressure decrease in the passageway to define pressure point readings which in effect characterize the essentially straight line function, the steps of recording the pressure point readings and comparing same in a progressive way as time elapses, and more points are available, to detect the departure of the pressure point readings from a straight line, and reducing the volume in the passageway when the slope of a line passing through successive pressure point readings differs from the slope of the straight line by about 2 to about 5 percent.

7. In process for rapidly, and accurately measuring with a test tool the formation pressure of a subsurface formation traversed by a fluid filled wellbore by establishing through a wall between said wellbore and said formation a passageway, isolated from said wellbore fluid, which extends into the body of the tool and is in communication with a pressure gauge for measuring the pressure exerted by connate fluids introduced into the passageway from the formation, and wherein is included a first liquid filled chamber of variable volume connected via a line to the passageway and pressure gauge, the volume of the chamber being changed by a reciprocally mounted piston which is advanced into the chamber to reduce, or retracted from the chamber to increase the volume of the chamber, and a second liquid filled chamber of fixed volume connected via a line to the passageway and said pressure gauge through a valve for opening and closing said second chamber to said passageway and gauge, the steps which comprise measuring the pressure in the passageway, retracting the piston of said first chamber to increase the volume of said variable volume chamber, and reduce the pressure sufficient to cause an essentially constant rate of pressure decrease in the passageway, defining in effect a substantially straight line function, and continuing to decrease the pressure in said passageway until the measured pressure in the passageway ceases to define a straight line function and begins to decrease at a decreasing rate, defines a minima, then keeping constant the volume of the chamber of variable volume so that the pressure in the passageway levels off at an essentially maximum value which accurately defines the formation pressure of said subsurface formation.

8. The process of claim 7 wherein the formation pressure is checked, beginning from the point defined as an essentially maximum value which characterizes the formation pressure, by again increasing the volume of the chamber of variable volume, measuring the pressure in the passageway as the pressure again begins to decrease at a decreasing rate, defines a second minima, then again keeping constant the volume of the chamber so that the pressure again increases and levels off at an essentially maximum value, then drawing a straight line through a number of plotted point of pressure readings lying between the initial point of maximum value where the check was begun and said second minima, and then comparing the slope of the straight line with the slope of the straight line function previously obtained.

9. The process of claim 7 wherein, to determine via calculation the permeability of the formation, the volume of the variable volume chamber is again gradually increased, the pressure again decreasing until it reaches a minima at which point the formation is producing exactly at the flowrate of the volume increase of the variable volume chamber; a value from which the calculation can be made to determine the permeability of the formation.

10. In the process of claim 7, wherein the wall of the wellbore is coated with mudcake, mudcake is trapped in the passageway leading into the formation, and the pressure in the passageway is greater than the formation pressure, the step of determining the supercharging effect of the subsurface formation by monitoring the pressure in the passageway before beginning retraction of the piston of the variable volume chamber to increase the volume of the variable volume chamber to determine the rate of filtration of connate fluids through the mudcake, the pressure gradually decreasing with time due to the filtration of connate fluids through the mudcake, this rate of decrease in pressure providing a measurement of the supercharging effect.

11. The process of claim 7 including, as the chamber of variable volume is increased to reduce the pressure to cause an essentially constant rate of pressure decrease in the passageway to define in effect the essentially straight line function, the steps of monitoring the pressure decrease in the passageway in order to calculate the best straight line fit and the standard deviation, comparing the last value of the pressure measured with a value calculated using the straight line, and reducing the volume in the passageway to a minimum if the difference between the last value of the pressure measured and the value calculated exceeds about two standard deviations.

12. The process of claim 7 including, as the chamber of variable volume is increasd to reduce the flowline pressure to cause an essentially constant rate of pressure decrease in the passageway to define pressure point readings which in effect characterize the essentially straight line function, the steps of recording the pressure point readings and comparing same in a progressive way as time elapses, and more points are available, to detect the departure of the pressure point readings from a straight line, and reducing the volume in the passageway when the slope of a line passing through successive pressure point readings differs from the slope of the straight line by about 2 to about 5 percent.

* * * * *

UNITED STATES PATENT AND TRADEMARK OFFICE

CERTIFICATE OF CORRECTION

PATENT NO. : 5,233,866

DATED : 08/10/93

INVENTOR(S) : Robert Desbrandes

It is certified that error appears in the above-identified patent and that said Letters Patent is hereby corrected as shown below:

On the title page, item (73) Assignee, should read --

Gas Research Institute
Chicago, Ill.

--.

Signed and Sealed this

Seventh Day of June, 1994

*Attest:*

*Attesting Officer*

BRUCE LEHMAN

*Commissioner of Patents and Trademarks*